US006978770B2

(12) United States Patent
Rauznitz et al.

(10) Patent No.: US 6,978,770 B2
(45) Date of Patent: Dec. 27, 2005

(54) PIEZOELECTRIC FUEL INJECTION SYSTEM WITH RATE SHAPE CONTROL AND METHOD OF CONTROLLING SAME

(75) Inventors: Peter Rauznitz, Columbus, IN (US); Lester L. Peters, Columbus, IN (US); John D. Crofts, Edinburgh, IN (US); William D. Meyer, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 10/843,357

(22) Filed: May 12, 2004

(65) Prior Publication Data

US 2005/0252494 A1 Nov. 17, 2005

(51) Int. Cl.[7] ..... F02M 37/04
(52) U.S. Cl. ..... 123/498; 123/496
(58) Field of Search ..... 123/498, 299–300, 123/496

(56) References Cited

U.S. PATENT DOCUMENTS

| | | | | |
|---|---|---|---|---|
| 4,621,599 | A * | 11/1986 | Igashira et al. | 123/300 |
| 4,730,585 | A | 3/1988 | Abe et al. | |
| 4,732,129 | A | 3/1988 | Takigawa et al. | |
| 4,821,726 | A | 4/1989 | Tamura et al. | |
| 5,057,734 | A * | 10/1991 | Tsuzuki et al. | 310/317 |
| 5,165,373 | A * | 11/1992 | Cheng | 123/300 |
| 5,694,903 | A | 12/1997 | Ganser | |
| 5,779,149 | A | 7/1998 | Hayes, Jr. | |
| 5,803,361 | A | 9/1998 | Horiuchi et al. | |
| 5,819,704 | A | 10/1998 | Tarr et al. | |
| 5,860,597 | A * | 1/1999 | Tarr | 239/124 |
| 5,884,848 | A | 3/1999 | Crofts et al. | |
| 6,253,736 | B1 | 7/2001 | Crofts et al. | |
| 6,345,606 | B1 | 2/2002 | Ricci-Ottati et al. | |
| 6,367,453 | B1 | 4/2002 | Igashira et al. | |
| 6,412,704 | B2 | 7/2002 | Shinogle et al. | |
| 6,420,817 | B1 | 7/2002 | Ricci-Ottati et al. | |
| 6,486,587 | B2 * | 11/2002 | Klenk et al. | 310/316.03 |
| 6,619,268 | B2 * | 9/2003 | Rueger et al. | 123/490 |
| 6,700,301 | B2 * | 3/2004 | Rueger et al. | 310/316.03 |
| 2001/0027780 | A1 | 10/2001 | Rueger et al. | |

* cited by examiner

*Primary Examiner*—Thomas Moulis
(74) *Attorney, Agent, or Firm*—Nixon Peabody LLP; Tim L. Brackett, Jr.; J. Bruce Schelkopf

(57) ABSTRACT

A piezoelectric fuel injection system and a method of controlling same are provided which include a piezoelectric fuel injector having a piezoelectric element, a power source adapted to provide power to the piezoelectric element to actuate the piezoelectric fuel injector, and a controller adapted to charge the piezoelectric element to an initial voltage to begin said injection event, to decrease the voltage from the initial voltage to an intermediate voltage, and to increase the voltage from the intermediate voltage to a primary voltage to thereby control the injection rate shape. The initial voltage level is at least approximately equal to said primary voltage level and preferably approximately equal to a maximum voltage rating. The initial voltage duration, the intermediate voltage duration and the magnitude of the intermediate voltage can be changed or varied to modify the injection or rate shape.

44 Claims, 5 Drawing Sheets

PIEZOELECTRIC FUEL INJECTION SYSTEM WITH RATE SHAPE CONTROL AND METHOD OF CONTROLLING SAME

BACKGROUND OF THE INVENTION

1. Field of the Invention

The present invention is directed to piezoelectric injection systems having a mechanism for controlling rate shape, and to methods for controlling such piezoelectric injection systems.

2. Description of Related Art

In most fuel supply systems applicable to internal combustion engines, fuel injectors are used to inject fuel pulses into the engine combustion chamber. A commonly used injector is a closed-nozzle injector which includes a nozzle assembly having a spring-biased nozzle valve element positioned adjacent the nozzle orifice for allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring so that when the pressure of the fuel within the nozzle cavity exceeds the biasing force of the nozzle spring, the nozzle valve element moves outwardly to allow fuel to pass through the nozzle orifices, thus marking the beginning of the injection event.

In another type of system, such as disclosed in U.S. Pat. No. 5,819,704, the beginning of injection event is controlled by a servo-controlled needle valve element. The system includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve.

Internal combustion engine designers have increasingly come to realize that substantially improved fuel supply systems are required in order to meet the ever increasing governmental and regulatory requirements of emissions abatement and increased fuel economy. Specifically, it is known that improved control of fuel metering into the combustion chamber, is essential in reducing the level of emissions generated during combustion process while minimizing fuel consumption, for example, in combustion of diesel fuel. In addition, it is known that improved control of the rate of fuel injected during the course of an injection event, i.e. the rate shape of the injection, is also very important in reducing the level of emissions generated, especially in diesel fuel combustion. As a result, many proposals have been made to provide fuel metering control and rate shape control for closed nozzle fuel injector systems, including such systems that utilize piezoelectric fuel injectors.

For instance, U.S. Pat. No. 5,779,149 to Hayes, Jr. discloses a piezoelectric controlled common rail fuel injector. The piezoelectric actuator controls the movement of an inwardly opening poppet-type control valve for controlling the flow of fuel from a control volume and ultimately, the movement of the nozzle valve element. The reference further discloses that fuel metering is variably controlled by controlling the duration and modulation of the electrical signal that is provided to the piezoelectric actuator. Although the above-described reference provides some control over fuel metering, and thus, control over the amount of fuel injected, the reference does not provide a solution for effectively controlling rate shape of the fuel injections.

U.S. Pat. No. 6,253,736 to Crofts et al. discloses a piezoelectric fuel injector nozzle assembly having feedback control with a nozzle valve control arrangement that operates to control the movement of the nozzle valve element. The reference discloses that the nozzle valve control arrangement functions to control the quantity of the fuel metered, and also functions as a rate shaping control device for producing a predetermined time varying change in the flow rate of fuel injected into the combustion chamber during an injection event so as to improve combustion and minimize emissions. The reference further discloses that the injection rate shape is controlled by varying the voltage supplied to the piezoelectric actuator based on engine operating conditions.

U.S. Pat. No. 4,732,129 to Takigawa et al. discloses an injector with an electroexpansive actuator. The actuator voltage is controlled to ultimately vary the movement of a nozzle needle thereby enabling fuel injection at different injection rates.

U.S. Pat. No. 6,367,453 to Igashira et al. discloses a method of controlling injection rate shape by applying voltage to piezo actuator such that the injection rate increases slowly when voltage is applied to the piezo actuator and decreases rapidly when voltage is applied to the piezo actuator is stopped, thereby creating a triangular rate shape. The injector uses a three-way valve and a specific size ratio of main and sub orifices to achieve slow needle opening and quick needle closing motion.

Methods of controlling fuel injectors such as that disclosed in Crofts et al. typically provide an input signal, i.e. voltage, current, etc., to a piezoelectric element, an electromagnetic actuator, or a magnetostrictive actuator to thereby operate the fuel injector. As disclosed in Crofts et al., rate shape of fuel injections is also controlled in the same manner by changing the magnitude of the input signal. However, controlling the rate shape of fuel injections by varying the input signal in the manner known has been found to not provide the desired results in various instances when accurate rate shaping would be desirable.

Thus, despite the teachings of the art discussed above, alternative systems and methods for controlling injection rate shape using piezoelectric fuel injectors are desirable to provide further control of combustion and emissions generated by such combustion, and to further improve fuel economy. Therefore, there still exists an unfulfilled need for a piezoelectric fuel injection system having enhanced rate shape control, and a method for controlling a piezoelectric fuel injector in which enhanced rate shape is attained.

SUMMARY OF THE INVENTION

In view of the foregoing, an aspect of the present invention is a piezoelectric fuel injection system to aid in reducing exhaust emissions and improving fuel economy, especially in engines not using exhaust gas recirculation.

Another aspect of the present invention is a piezoelectric fuel injection system having enhanced rate shape control.

Still another aspect of the present invention is a method for controlling a piezoelectric fuel injection system in which enhanced rate shape is attained.

Thus, in accordance with one aspect of the present invention, a piezoelectric fuel injection system for an internal combustion engine is provided to allow injection of fuel during an injection event and comprises a piezoelectric element actuatable to inject fuel during said injection event, a power source adapted to provide voltage to said piezoelectric element, and a controller adapted to control the power source to charge the piezoelectric element to an initial voltage to begin the injection event, to decrease the voltage from the initial voltage to an intermediate voltage, and to increase the voltage from the intermediate voltage to a primary voltage to thereby control a rate of fuel injected during the injection event, wherein the initial voltage is at least approximately equal to the primary voltage. That is, the initial voltage is no less than approximately the primary voltage. The initial voltage and the primary voltage may be approximately equal. Also, the initial voltage may be greater than or equal to at least approximately 50% of a maximum voltage rating of the piezoelectric element but still at least approximately equal to the primary voltage. Preferably, the initial voltage may be greater than or equal to at least approximately 90% of the maximum voltage rating, and may be approximately equal to 100% of the maximum voltage rating. The intermediate voltage may be greater than 40% of the initial voltage and less than 70% of the initial voltage. The controller may be adapted to maintain the initial voltage for an initial voltage duration and vary the initial voltage duration to control the fuel injection rate. The controller may also be adapted to maintain the intermediate voltage for an intermediate voltage duration and vary the intermediate voltage duration to control the fuel injection rate. The controller may also be adapted to vary the intermediate voltage level to control the fuel injection rate.

The above system preferably includes a piezoelectric fuel injector actuatable to inject fuel during the injection event, with the piezoelectric element incorporated into the fuel injector body. The piezoelectric fuel injector may include an injector cavity, an injector orifice communicating with one end of the injector cavity to discharge fuel into a combustion chamber, and a nozzle valve element positioned in one end of the injection cavity adjacent the injector orifice for movement between an open position in which fuel may flow through the injector orifice into the combustion chamber and a closed position in which fuel flow through the injector orifice is blocked. The charge of the piezoelectric element to the initial voltage causes a rapid opening of the nozzle valve element and a corresponding rapid increase in the fuel injection rate, and the decrease of the voltage from the initial voltage to the intermediate voltage causes, in one embodiment, an opening of the nozzle valve element slower than the rapid opening and a slower increase in the fuel injection rate than the rapid increase, and, in another embodiment, the nozzle valve element to be maintained in a partially opened position resulting in an essentially steady state injection. Preferably, the increase of the voltage from the intermediate voltage to the primary voltage causes the nozzle valve element to move to a fully open position and the injection rate to reach a maximum level, wherein the controller is further adapted to maintain the primary voltage for a predetermined period of time.

The piezoelectric fuel injector preferably further includes a control volume positioned at one end of the nozzle valve element, a drain circuit for draining fuel from the control volume to a low pressure drain, and an injection control valve positioned along the drain circuit to control fuel flow from the control volume to control movement of the nozzle valve element, wherein the piezoelectric element controls the movement of the injection control valve.

In another embodiment, the invention includes a method for implementing the present invention.

These and other aspects of the present invention will become more apparent from the following detailed description of the preferred embodiments of the present invention when viewed in conjunction with the accompanying drawings.

DETAILED DESCRIPTION OF THE PREFERRED EMBODIMENT

FIG. 1 shows a schematic illustration of a piezoelectric fuel injection system 2 in accordance with one embodiment of the present invention that avoids the above noted limitations of conventional fuel injection systems. As described in further detail below, the piezoelectric fuel injection system 2 allows enhanced control of the rate of fuel injected during an injection event of a combustion cycle in an internal combustion engine, for example, a diesel engine, so that the injection rate shape can be effectively controlled. Of course, the present invention may also be applied to other types of internal combustions as well.

The piezoelectric fuel injection system 2 of the illustrated embodiment includes a controller 4, e.g. electronic control unit, that is connected to a power source 6, the controller 4 being adapted to control the power source 6. The power source 6 of the piezoelectric fuel injection system 2 is connected to a fuel injector 10 and provides power thereto in the manner as further described below in accordance with the present invention. Fuel injector 10 receives fuel from a fuel source and is adapted to inject the received fuel into a combustion chamber of an internal combustion engine (not shown) during an injection event of a combustion cycle, details of the internal combustion engine and combustion cycles being known in the art and thus, being omitted herein.

Figure 1A:
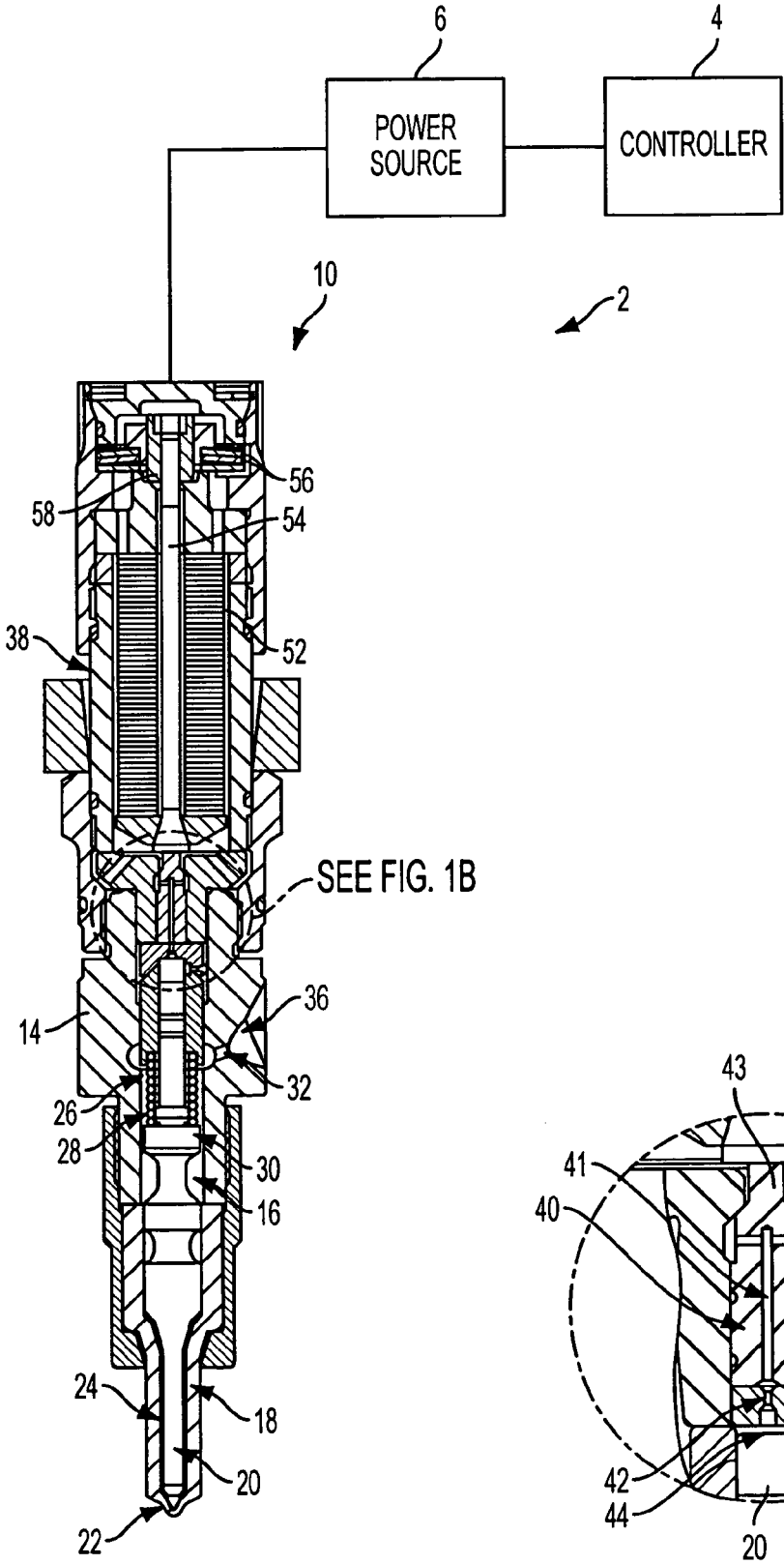
FIG. 1A is a schematic illustration of a piezoelectric fuel injection system, including is a cross-sectional view of a piezoelectric fuel injector, in accordance with one embodiment of the present invention.
Figure 1B:
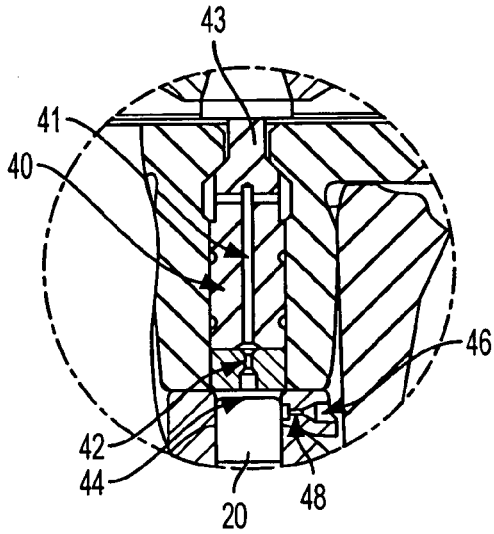
FIG. 1B is an enlarged cross-sectional view of a portion of the piezoelectric fuel injector of FIG. 1A.

Referring to FIG. 1A, a cross-sectional view of fuel injector 10 of the present invention is shown which is utilized in the implementation of the piezoelectric fuel injection system 2 in accordance with one example embodiment. As explained in detail below, fuel injector 10 functions to effectively permit accurate and variable control of fuel metering while also providing injection rate shaping in accordance with the present method. It should be initially noted that whereas specific details regarding the structure of the fuel injector 10 are shown in FIGS. 1A and 1B and discussed herein, fuel injector 10 is merely one example implementation thereof and other appropriately designed injectors may be utilized in the implementation of the present invention.

As can be appreciated by one of ordinary skill in the art by examination of FIG. 1A, fuel injector 10 is a closed nozzle type that is commonly utilized in high pressure common rail or pump-line-nozzle systems. For example, U.S. Pat. No. 6,253,736 to Crofts et al., the entire contents of which is incorporated herein by reference, discloses a fuel injector similar to fuel injector 10 shown that may be used in a high pressure fuel system. However, the system and method of the present invention may further be applied to other types of fuel injection systems utilizing other types of injectors as well.

In the embodiment shown in FIG. 1A, fuel injector 10 is comprised of an injector body 14 having a generally elongated, cylindrical shape which forms an injector cavity 16. The lower portion of fuel injector body 14 includes a closed nozzle assembly 18, which includes a nozzle valve element 20 reciprocally mounted for opening and closing injector orifices 22, thereby controlling the flow of injected fuel into an engine combustion chamber. The injector of FIG. 1A is also disclosed and discussed in detail in U.S. patent application Ser. No. 10/179,017 filed Jun. 26, 2002, entitled Fuel Injector with Feedback Control, the entire contents of which is hereby incorporated by reference.

Nozzle valve element 20 is preferably formed from an integral piece structure and positioned in a nozzle cavity 24 and a spring cavity 26. The spring cavity 26 contains a bias spring 28 for abutment against a land 30 formed on nozzle valve element 20 so as to bias nozzle valve element 20 into a closed position as shown in FIG. 1A. A fuel transfer circuit 32 is provided in the injector body 14 for supplying high pressure fuel from an inlet 36 to nozzle cavity 24 via spring cavity 26. For example, fuel injector 10 may be provided with high pressure fuel from a high pressure common rail or a pump-line-nozzle system.

Fuel injector 10 further includes a nozzle valve control arrangement indicated generally at 38 for controlling the movement of nozzle valve element 20 between open and closed positions, the initial opening of the nozzle valve element defining the beginning of an injection event during which fuel flows through injector orifices 22 into the combustion chamber of the internal combustion engine. Specifically, nozzle valve control arrangement 38 operates to initiate, and control the movement of nozzle valve element 20 including the degree of opening and the rate of opening of nozzle valve element 20. In addition, nozzle valve control arrangement 38 operates to maintain nozzle valve element 20 in the open position for a specified duration so as to control the quantity of fuel injected. The degree of opening, the rate of opening, and the duration of opening for nozzle valve element 20 are controlled based on the operating conditions of the engine, for example, engine speed, load, throttle position, etc.

When operated in accordance with the present invention, nozzle valve control arrangement 38 controls nozzle valve element 20 to control the rate shape of the fuel injection, especially during a first portion of an injection event. This allows time varying change in the flow rate of fuel injected into the combustion chamber during an injection event. Correspondingly, such control of the rate shape allows improved fuel economy while reducing emissions.

As most clearly shown in the enlarged view of FIG. 1B, nozzle valve control arrangement 38 in the illustrated embodiment of fuel injector 10 includes a reciprocally mounted control valve 40 positioned for abutment against a valve seat 43 when in a closed position, as shown. A control volume 44 is positioned between the lower end of control valve 40 and the upper end of nozzle valve element 20. A control volume charge circuit 46 is provided with an orifice 48 for directing pressurized fuel into control volume 44. Control valve 40 is provided with a control valve orifice 42 positioned along a drain circuit 41 partially formed in control valve 40 for draining fuel from control volume 44. Control valve 40 is movable between the closed position blocking fuel flow through drain circuit 41 and an open position permitting drain flow from control volume 44. As shown in FIG. 1A, control valve 40 is actuated by a piezoelectric element 52 of nozzle valve control arrangement 38 to allow selective movement of control valve 40 so as to control the amount of fuel in control volume 44, which in turn, controls the movement of nozzle valve element 20. In this regard, piezoelectric element 52 is operatively connected to control valve 40 via center rod 54 which abuts the upper end of control valve 40. Furthermore, in the illustrated embodiment, the preload of piezoelectric element 52 is adjustable via disc springs 56 and adjustment nut 58.

In the illustrated embodiment, piezoelectric element 52 comprises a columnar laminated body of thin disk-shaped elements, each having a piezoelectric effect so that when a voltage is applied to the piezoelectric element 52, the elements become charged and expand along the axial direction of the column. Of course, piezoelectric element 52 may be of any type or design in other embodiments that is suitable for actuating control valve 40 in the manner described hereinbelow. The expansion of piezoelectric element 52 causes downward movement of control valve 40, via center rod 54, into an open position away from valve seat 43 thereby permitting high pressure fuel to drain from control volume 44 via the drain circuit 41 which in turn causes the opening of nozzle valve element 20 and corresponding injection of fuel through injector orifices 22. A decrease in the voltage applied to piezoelectric element 52 causes axial contraction of the element 52, upward movement of center rod 54 and corresponding movement of control valve 40 toward the closed position which in turn causes either movement of nozzle valve element 20 toward the closed position or termination of an outward movement of nozzle valve element 20 to maintain element 20 in a desired partially open position.

The amount of expansion of piezoelectric element 52 corresponds to the specific design of the elements, the voltage being controlled, for example, by controller 4, and the amount of voltage applied to the piezoelectric element. In addition, the duration and amount of voltage provided by controller 4 determines the amount of fuel injected by fuel injector 10. The voltage duration and amount or level at various stages of the injection event are controlled or varied, as discussed hereinbelow, based on the operating conditions of the engine such as engine speed, engine load, throttle position, etc. At the end of an injection event, when the voltage is turned off, i.e. zero volts are provided, piezoelectric element 52 is discharged so that it reverts back to its original position thereby causing control valve 40 to move into the closed position which causes nozzle valve element 20 to move into its closed position.

Referring again to FIG. 1A, and as previously noted, the actuation and de-actuation (i.e. charging and discharging) of piezoelectric element 52 of nozzle valve control arrangement 38 is controlled by controller 4. The controller 4 is preferably implemented as an electronic control unit that is adapted to precisely control the operation of the piezoelectric element 52 to thereby control the timing of injection as well as the amount of fuel that is injected during the injection event. Moreover, the controller 4 in accordance with the present invention, is further adapted to control the injection rate shape so that emissions can be reduced and fuel economy enhanced.

During operation, prior to an injection invent, piezoelectric element 52 is de-energized causing control valve 40 to be biased into the closed position in sealing engagement against valve seat 43 by fuel pressure forces acting on the lowered distil end of control valve 40 due to the high pressure fuel in control volume 40. The fuel pressure level experienced in the injector cavity surrounding nozzle valve element 20 is also present in control volume drain circuit 41 and control volume 44 since drain flow through drain circuit 41 is blocked by control valve 40. As a result, the fuel pressure acting inwardly on nozzle valve element 20, in combination with the bias force of bias spring 28 maintains nozzle valve element 20 in its closed position blocking flow through injector orifices 22. At a predetermined time, controller 4 controls power source 6 so as to charge or energize piezoelectric element 52 with voltage to controllably cause the expansion of piezoelectric element 52 and movement of center rod 54 and control valve 40 from the closed position shown in FIG. 1B to an open position. The movement of control valve 40 is thus controlled by controlling the voltage applied to piezoelectric element 52. Thus the distance between control valve 40 and valve seat 43 is controlled to vary the drain flow from control volume 44 which ultimately permits precise control over the movement of nozzle valve element 20 between its closed and open positions. As control valve 40 is lifted from valve seat 43 fuel flows from control volume 44 through drain circuit 41 to a low pressure drain. Simultaneously, high pressure fuel flows from control volume charge circuit 46 and the associated orifice 48 into control volume 44. However, since the control volume charge circuit orifice 48 is designed with a smaller cross-sectional flow area than drain or control valve orifice 42, a greater amount of fuel is drained from control volume 44 than is replenished via control volume charge circuit 46. As a result, the pressure in control volume 44 immediately decreases. As a result of the decreasing control volume pressure, fuel pressure forces acting on nozzle valve of element 20 due to high pressure fuel in injector cavity 16, begin to move nozzle valve element 20 outwardly against the bias force of spring 28 into a partially open position.

As previously described, use of such conventional control methods has been found to be inadequate in accurately controlling rate shape of the injections in various situations. For example, it has been found that in order to reduce exhaust emissions in diesel engines, the rate of fuel injected into the combustion chamber during an injection event should be gradually increased to a desired steady state level instead of rapidly ramping up the rate of fuel injected to the desired steady state level at the very beginning of the injection event. Moreover, it is desirable to vary and control the injection rate of fuel (rate shape) during the injection event, and especially during an initial portion of the event.

Whereas the input signal provided to a fuel injector actuator may generally be controlled to gradually change over time, such a controlled input signal does not necessarily result in fuel injection having the desired gradually changing rate shape. At least with respect to injectors having servo-controlled nozzle valves, this inability to precisely control injection rate may be attributed to the fact that although the valve actuator, such as a piezoelectric element, can respond to the input signal in a precise and rapid manner, the nozzle valve element cannot be operated in a corresponding precise and rapid manner because the nozzle valve element is operated by controlling the amount of fuel in the control volume which requires time to flow into, or out, of the control volume. Thus, conventional fuel injectors cannot readily control the injection of fuel to achieve the desired injection rate shape. As a result, too much fuel or too little fuel can be injected into the combustion chamber by the fuel injector thereby resulting in an undesirable injection rate shape and corresponding increased emissions and/or fuel consumption.

Figure 2:
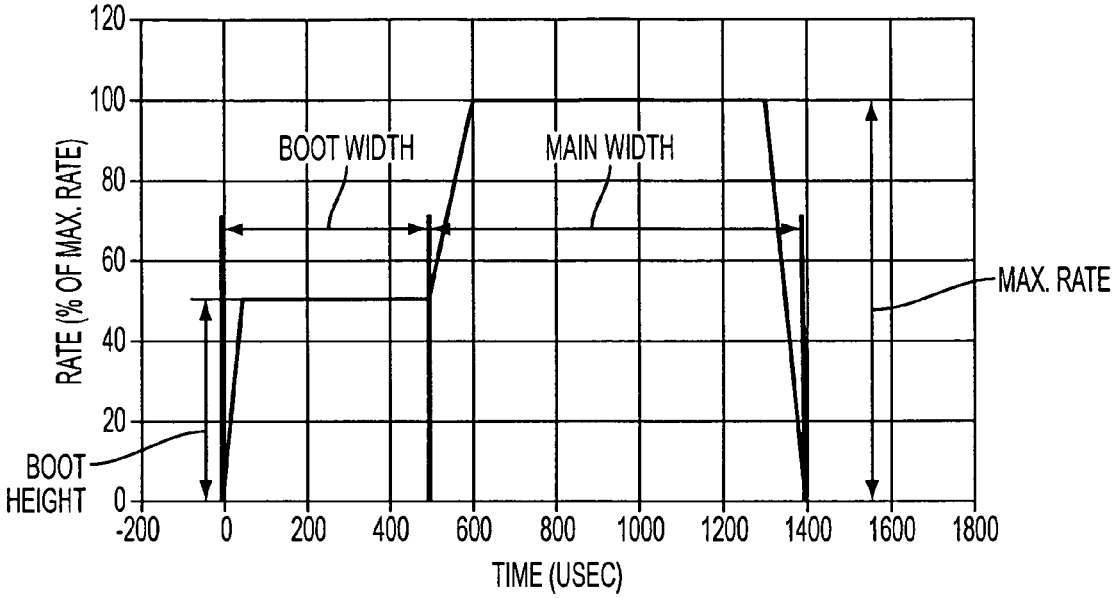
FIG. 2 is a graph illustrating the injection rate of a piezoelectric fuel injector versus time duration for an example injection event, in accordance with the present invention.
Figure 4:
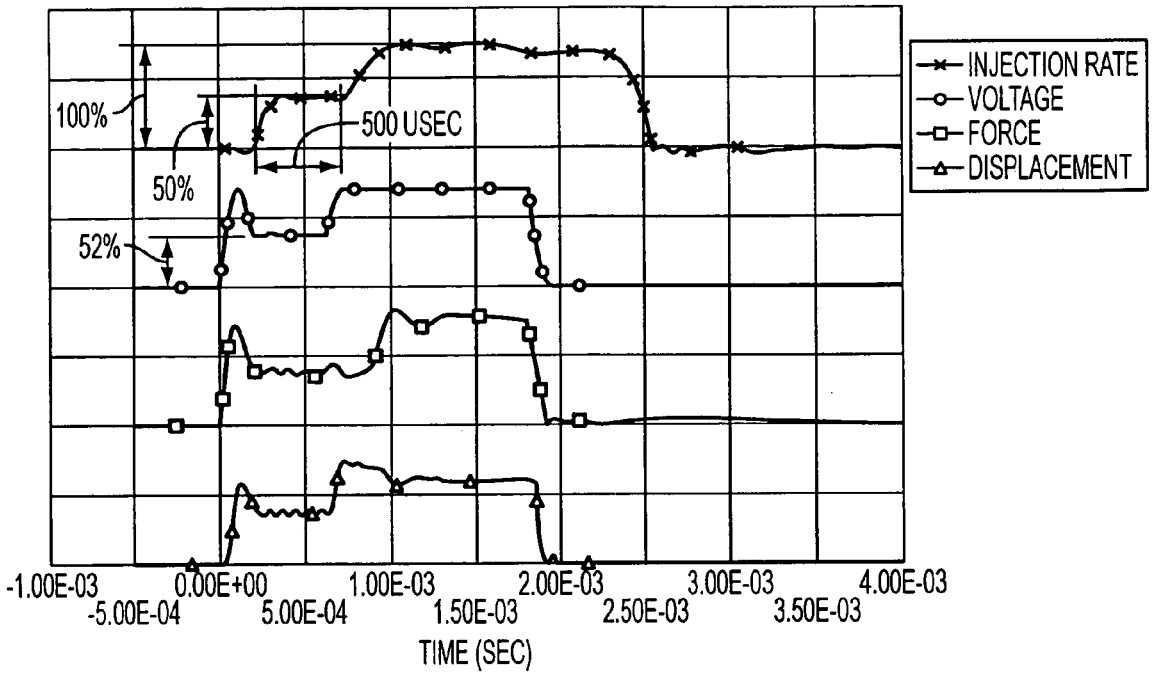
FIG. 4 is a graph illustrating fuel injection rate, voltage provided to the piezoelectric fuel injector, force between the piezoelectric actuator rod and the control valve, and displacement of the piezoelectric actuator rod and control valve, versus time duration for an example injection event, in accordance with one embodiment of the present invention.

Referring to FIG. 2, the piezoelectric fuel injection system 2, and the method, of the present invention is adapted to achieve a controllable, gradual increase in the fuel injection rate during an initial portion of an injection event followed by a primary injection at a higher injection rate. That is, the present invention effectively and controllably achieves a lower injection rate during a first portion of an injection event followed by a high injection rate during a later portion to thereby advantageously effect emissions and fuel consumption. For example, in FIG. 2, a "boot-shaped" injection rate for one injection event by the piezoelectric fuel injection system 2 of the present invention is shown. FIG. 4 shows actual test results of the boot-shaped injection rate, including the corresponding piezoelectric element/actuator voltage, force of the piezoelectric element or actuator 52 on control valve 40 and displacement of control valve 40. In this exemplary embodiment, the system and method of the present invention operates to rapidly raise the injection rate to an initial injection rate by causing nozzle valve element 20 to partially lift off its seat and move to a partially open position. Nozzle valve element 20 is then held at a partially opened position for a predetermined time period corresponding to the boot width in FIG. 2 after which nozzle valve element 20 is raised to its fully open position permitting injection at an injection rate greater than the initial injection rate, i.e. a maximum injection rate. At a predetermined time, nozzle valve element 20 is caused to move from the fully opened position to the closed position marking the end of the injection event.

The above-described fuel injection rate and nozzle valve element motion events are achieved by piezoelectric fuel injection system 2 of the present invention precisely controlling the movement of control valve 40 to control the pressure in control volume 44 thereby effectively and precisely controlling the movement of nozzle valve element 20. Specifically, piezoelectric fuel injection system 2 operates to control the voltage applied to piezoelectric element 52 of nozzle valve control arrangement 38 in such a manner as described hereinbelow to effectively and precisely control the expansion and contraction of the piezoelectric element 52 and thus the movement of control valve 40 to achieve the desired rate shape. The system and method of the present invention provides flexible rate shape capability for variably controlling the rate shape throughout engine operation depending on engine operating conditions by varying the voltage level and voltage duration at different times during the injection event as described hereinbelow. Thus, the present invention applies an electrical charge or voltage profile which effectively and precisely controls the movement of nozzle valve element 20 throughout the injection event to achieve a predetermined desired rate shape, such as a boot-shape.

Figure 3:
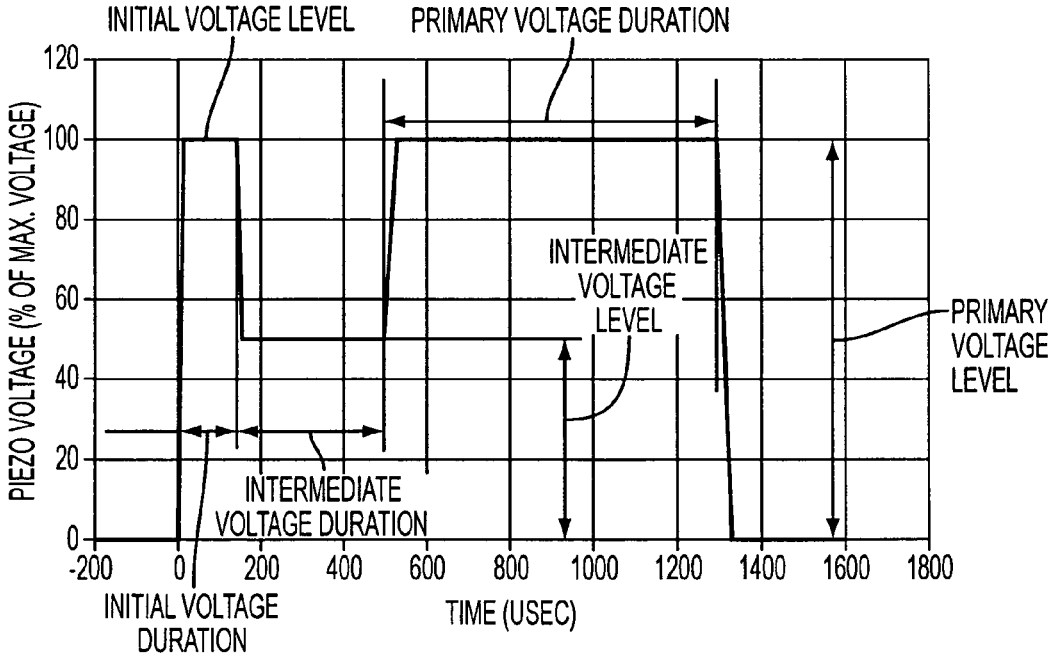
FIG. 3 is a graph illustrating voltage provided to the piezoelectric fuel injector of the present invention, versus time duration for an example injection event, in accordance with the present invention.

Referring to FIG. 3, the piezoelectric fuel injection system and method of the present invention initiates an injection event by controller 4 switching power source 6 on to charge piezoelectric element 52 to an initial voltage and then subsequently decreasing the voltage from the initial voltage to an intermediate voltage less than the initial voltage as shown in FIG. 3. Then, controller 4 controls power source 6 such that the voltage supplied to the piezoelectric element 52 is increased from the intermediate voltage to a primary voltage greater than the intermediate voltage. Importantly, the initial voltage is of a magnitude that is at least equal to approximately the primary voltage. By controlling the magnitude or level of the voltage provided to piezoelectric element 52 as described and also controlling the voltage duration as described hereinbelow, the voltage profile, as shown in FIG. 3, effectively and precisely controls the movement of nozzle valve element 20 so as to achieve the boot-shaped injection rate shown in FIG. 2.

More specifically, upon the initiation of an injection event, the piezoelectric element 52 is charged to an initial voltage which insures a rapid partial opening of nozzle valve element 20. This initial voltage is at least equal to approximately the primary voltage. Moreover, preferably, this initial voltage is greater than or equal to at least the approximately 50% of the maximum voltage rating of the piezoelectric element 52. In the example of FIG. 3, the initial voltage and the primary voltage are approximately equal to 100% of the maximum voltage rating. The maximum rating may be, for example, 200 or 1000 volts. The closer the initial voltage is to the maximum voltage rating, the more quickly the control valve 40 opens resulting in a more rapid opening of nozzle valve element 20. Of course, the primary voltage may be less than the initial voltage and still achieve the desired rapid partial opening of the nozzle valve element 20. The initial voltage is then maintained for a predetermined duration of time after which the voltage on the piezoelectric element 52 is discharged rapidly to the intermediate voltage causing contraction of the piezoelectric element 52 and the partial closing of control valve 40 to cause nozzle valve element 20 to be maintained in a partial open position. The initial voltage duration is thus selected to control the level of opening of nozzle valve element 20 and thus the resulting rate shape as described more fully hereinbelow. The intermediate voltage is then maintained for an intermediate voltage duration which, in effect, controls the width of the boot in FIG. 2. At a predetermined time during the injection event, the piezoelectric element 52 is charged from the intermediate voltage to the primary voltage to cause the control valve 40 to fully open which in turn causes nozzle valve element 20 to fully open resulting in a primary portion of the injection event during which the injection rate is at its highest level. At the end of the injection event, control valve 40 will be closed by fully discharging piezoelectric element 52 to zero voltage. That is, when the voltage to the injector is turned off, the voltage to the piezoelectric fuel injector 10 decays to zero in a short period of time to discharge the piezoelectric element of the fuel injector 10. As a result, control valve 40 closes followed by the closing of nozzle valve element 20.

The actual test results using the piezoelectric fuel injection system of the present invention to achieve a boot-shaped injection rate as shown in FIG. 4 were achieved with an initial voltage level of 100% of the maximum voltage rating for an initial voltage duration of 120 $\mu$sec. The intermediate voltage level was approximately 52% of the maximum voltage and the intermediate voltage duration was 500 micro seconds. By controlling the voltage levels and the voltage durations, the boot-shaped rate was achieved with a boot length of approximately 500 micro seconds, a boot height of approximately 50% of the maximum injection rate height and a main injection width of approximately 1200 micro seconds.

Figure 5:
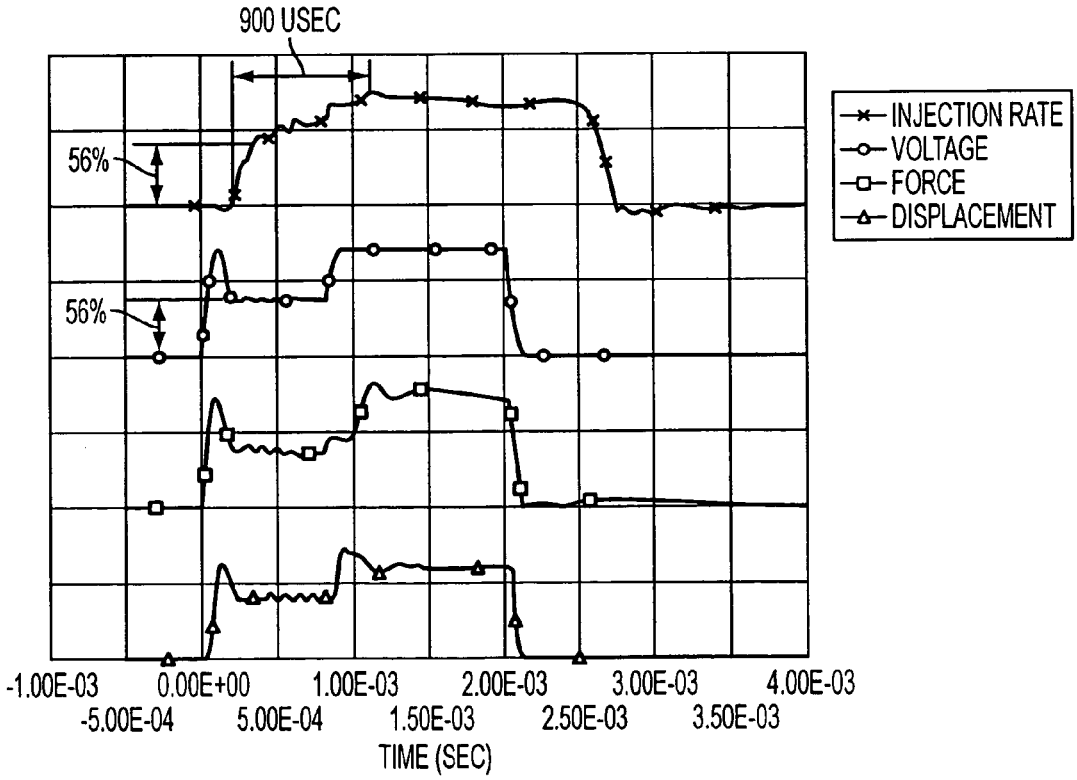
FIG. 5 is a graph illustrating fuel injection rate, voltage provided to the piezoelectric fuel injector, force between the piezoelectric actuator rod and the control valve, and displacement of the piezoelectric actuator rod and control valve, versus time duration for an example injection event, in accordance with one embodiment of the present invention.

Referring to FIG. 5, the piezoelectric fuel injection system 2, and method, of the present invention can also be used to create other injection rate profiles or shapes. For example, FIG. 5 shows a triangular rate shape created by a slightly higher intermediate voltage level than the voltage level of the embodiment shown in FIG. 4. Specifically, the intermediate voltage is maintained at 56% of the maximum voltage rating, instead of 52%. As a result, control valve 40 is slightly more opened than the previous embodiment thereby creating a greater pressure decrease in control volume 44. Ultimately, this results in nozzle valve element 20 lifting more slowly resulting in the triangular rate shape as shown. In this example, the initial voltage was maintained for 120 $\mu$sec while the intermediate voltage was maintained for 700 micro seconds. Also, the primary voltage was maintained for 1200 $\mu$sec. The injection rate reached a maximum value after approximately 900 $\mu$sec from the beginning of the injection event.

Importantly, the system and method of the present invention permits the injection rate shape to be actively adjusted and varied based on engine operating conditions during the full operating range of an engine. Specifically, the desired rate shape for any particular set of engine operating conditions can be achieved by changing one or more of three primary control parameters of the voltage provided to the piezoelectric element 52 using controller 4. Specifically, referring to FIGS. 6–8, the initial voltage duration, the intermediate voltage duration and the magnitude of the intermediate voltage can be changed or varied to modify the injection or rate shape. The changes to these parameters can be made easily and effectively utilizing controller 4 based on engine operating conditions such that as conditions change, one or more the parameters are varied to achieve a desirable rate shape which optimizes emissions reduction and fuel efficiency for the particular engine operating conditions.

Figure 6:
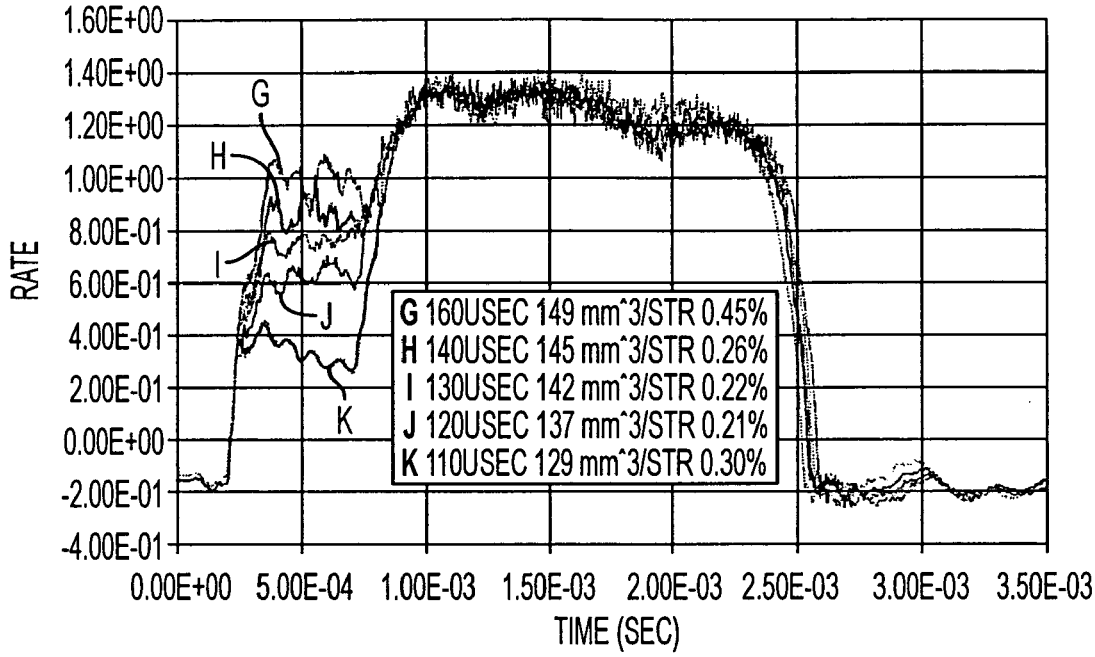
FIG. 6 is a graph illustrating fuel injection rate versus time duration for various injection events having the initial voltage held for different time periods to demonstrate the effect of the initial voltage duration on fuel injection rate shape.

FIG. 6 illustrates the effects of the initial voltage duration on the fuel injection rate shape. As can be seen, as the initial voltage duration is decreased, the boot height is decreased.

In the example shown, the trace indicated by G represents the longest initial voltage duration while trace K represents the shortest initial voltage duration. Thus, as less time is permitted for the piezoelectric element 52 to charge and thus less movement of control valve 40 occurs, correspondingly nozzle valve element 20 moves less in the opening direction to a smaller partial open position permitting less fuel through injector orifices 22. Conversely, a longer initial voltage duration results in a greater boot height since a greater amount of piezoelectric element expansion occurs resulting in a greater opening of control valve 40 and thus more movement of nozzle valve element 20 toward the open position. That is, a larger initial voltage duration results in a greater partial nozzle valve element lift.

Figure 7:
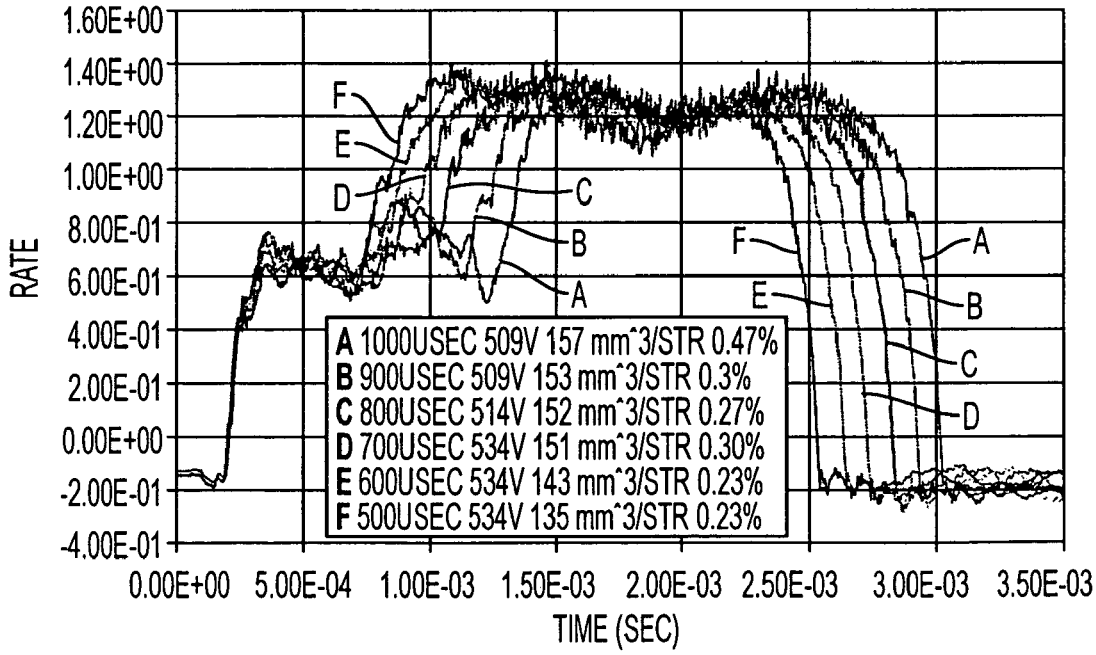
FIG. 7 is a graph illustrating fuel injection rate versus time duration for various injection events having the intermediate voltage held for different time periods to demonstrate the effect of the intermediate voltage duration on fuel injection rate shape.

FIG. 7 illustrates the effects of controlling the intermediate voltage duration on the injection rate shape. Specifically, as the intermediate voltage duration decreases, the boot width decreases. In the example shown, trace A represents the longest intermediate voltage duration while trace F represents the shortest intermediate voltage duration. Thus, as the intermediate voltage duration increases, the longer the nozzle valve element 20 is held in a partial lift state thus extending the lower initial injection rate for a longer period of time. Under certain engine operating conditions, varying the boot width may be desirable relative to emissions control and fuel efficiency.

Figure 8:
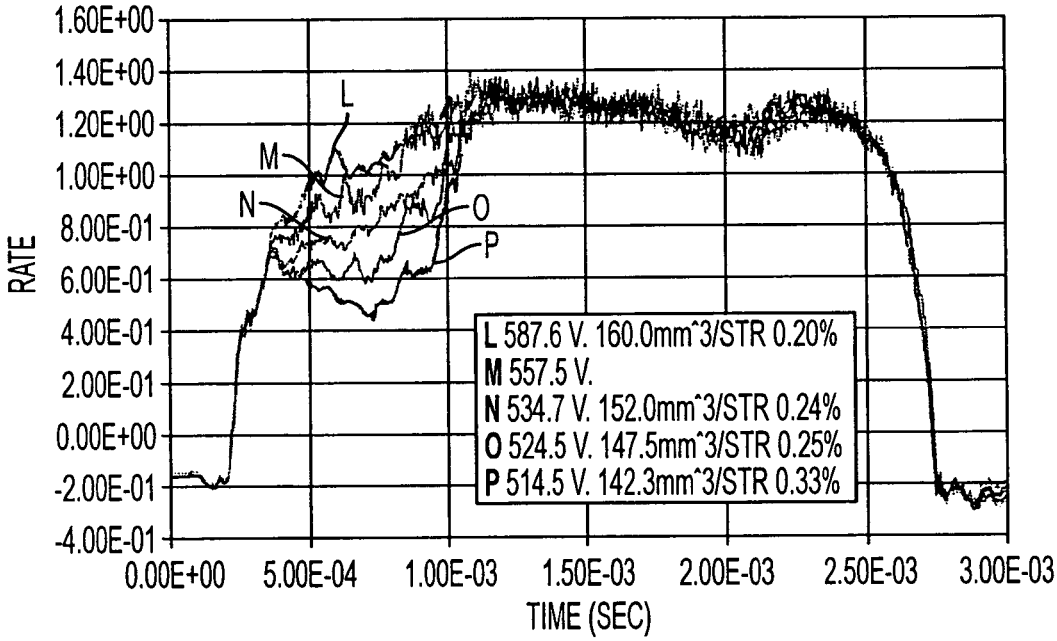
FIG. 8 is a graph illustrating fuel injection rate versus time duration for various injection events having different magnitudes for the intermediate voltage to demonstrate the effect of the intermediate voltage magnitude on fuel injection rate shape.

FIG. 8 illustrates the effect of changes in the intermediate voltage level on the injection rate shape. It can be seen that an increase in the intermediate voltage level causes more of a triangular shaped injection rate whereas a decrease in the intermediate voltage level results in more of a boot-shaped profile. In the example shown, trace L represents the largest intermediate voltage level while trace P represents the smallest intermediate voltage level. With the triangular shaped injection rate, the decrease of the voltage from the initial voltage to the intermediate voltage causes an opening of the nozzle valve element slower than the initial rapid opening and a slower increase in the fuel injection rate than the initial rapid increase. Again, the present invention thereby permits changes in the rate shape to match engine operating conditions and permit varying the rate shape during engine operation to ensure optimized emissions reduction and enhanced fuel efficiency. Thus, the magnitude of the intermediate voltage controls the slope of the fuel injection rate during the intermediate stage or phase when the intermediate voltage is maintained. Preferably, the intermediate voltage is greater than approximately 40% and less than approximately 70% of the initial voltage level.

It should be noted that variations of the present invention are considered within the scope of the present invention. For example, the various voltage levels, including the initial, intermediate and primary voltage levels may vary throughout the particular stage without deviating from the present invention as long as the primary relationships between the voltage levels are maintained as described herein. Also, additional voltage levels may be included in an injection event as long as the initial, intermediate and primary voltage levels, and their magnitude relationships, are present. For example, the primary voltage may consist of two different voltage levels. Thus, the piezoelectric fuel injection system 2 of the present invention creates a voltage profile including at least three step functions to open control valve 40 to lift the nozzle valve element 20 to a partial lift position to develop a low injection rate, then partially close control valve 40 to keep nozzle valve element 20 in the partial lift position, and then more fully open control valve 40 to further lift nozzle valve element 20 to develop the full injection flow rate.

The present invention is advantageous over conventional piezo actuator control methods for injectors. One conventional control scheme applies low electrical charge rates to the piezo elements resulting in a low voltage rate. Consequently, the control valve is slow to open which causes a low pressure drop rate in the control volume and thus a delayed, slowly increasing injection rate. This conventional control scheme results in a system that is difficult to control and provides unsatisfactory injection rate control throughout engine operating conditions thereby failing to optimize emissions reduction. Another conventional control scheme initially applies a maximum voltage which is then continuously maintained until the end of the injection event causing the injection rate to ramp up quickly to the steady state injection rate. As previously described, this rapid ramp-up in the injection rate, especially during the early stage of an injection event, causes increased emissions and decreased fuel economy. The present invention permits selective, variable voltage control, and thus rate shaping throughout engine operation thereby permitting the injection flow rate to be controlled based on varying engine conditions by simple changes to specific controllable piezoelectric voltage parameters. The present invention can be operated to permits cycle-by-cycle controllable rate shaping. The present flexible and actively controllable rate shaping system, injector and method is especially advantageous on engines not having other means, such as exhaust gas recirculation, for achieving desired emission levels.

Finally, as previously noted, the present invention may be combined with other control strategies for controlling rate shape to provide further flexibility in controlling the rate shape such as a boot-shaped injection rate shape, a triangular injection rate shape, or any other desired injection rate shape.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. A piezoelectric fuel injection system for an internal combustion engine, said piezoelectric fuel injection system being adapted to allow injection of fuel during an injection event, said piezoelectric fuel injection system comprising:

a piezoelectric element actuatable to inject fuel during said injection event;

a power source adapted to provide voltage to said piezoelectric element; and a controller adapted to control said power source to charge said piezoelectric element to an initial voltage to begin said injection event, to decrease the voltage from said initial voltage to an intermediate voltage, and to increase the voltage from said intermediate voltage to a primary voltage to thereby control a rate of fuel injected during said injection event, said initial voltage being at least approximately equal to said primary voltage.

2. The system of claim 1, wherein said initial voltage and said primary voltage are approximately equal.

3. The system of claim 1, wherein said piezoelectric element has a maximum voltage rating, said initial voltage being greater than or equal to at least approximately 50% of said maximum voltage rating.

4. The system of claim 3, wherein said initial voltage is greater than or equal to at least approximately 90% of said maximum voltage rating.

5. The system of claim 1, wherein said piezoelectric element has a maximum voltage rating, said initial voltage being approximately equal to 100% of said maximum voltage rating.

6. The system of claim 1, wherein said intermediate voltage is greater than 40% of said initial voltage and less than 70% of said initial voltage.

7. The system of claim 1, wherein said controller is adapted to maintain said initial voltage for an initial voltage duration and vary the initial voltage duration to control the fuel injection rate.

8. The system of claim 1, wherein said controller is adapted to maintain said intermediate voltage for an intermediate voltage duration and vary the intermediate voltage duration to control the fuel injection rate.

9. The system of claim 1, wherein said controller is adapted to vary said intermediate voltage level to control the fuel injection rate.

10. A piezoelectric fuel injection system for an internal combustion engine, said piezoelectric fuel injection system being adapted to inject fuel during an injection event of a combustion cycle, said piezoelectric fuel injection system comprising:

a piezoelectric fuel injector actuatable to inject fuel during said injection event, said piezoelectric fuel injector having a piezoelectric element;

a power source adapted to provide voltage to said piezoelectric element to actuate said piezoelectric fuel injector; and a controller adapted to control said power source to charge said piezoelectric element to an initial voltage to begin said injection event, to decrease the voltage from said initial voltage to an intermediate voltage, and to increase the voltage from said intermediate voltage to a primary voltage to thereby control a rate of fuel injected by said piezoelectric fuel injector during said injection event, said initial voltage being at least approximately equal to said primary voltage.

11. The system of claim 10, wherein said piezoelectric fuel injector includes an injector cavity, an injector orifice communicating with one end of said injector cavity to discharge fuel into a combustion chamber, and a nozzle valve element positioned in one end of said injection cavity adjacent said injector orifice for movement between an open position in which fuel may flow through said injector orifice into the combustion chamber and a closed position in which fuel flow through said injector orifice is blocked, wherein the charge of said piezoelectric element to the initial voltage causes a rapid opening of said nozzle valve element and a corresponding rapid increase in the fuel injection rate, and the decrease of the voltage from said initial voltage to said intermediate voltage causes an opening of said nozzle valve element slower than said rapid opening and a slower increase in the fuel injection rate than said rapid increase.

12. The system of claim 11, wherein the increase of the voltage from said intermediate voltage to said primary voltage causes said nozzle valve element to move to a fully open position and the injection rate to reach a maximum level, said controller being further adapted to maintain said primary voltage for a predetermined period of time.

13. The system of claim 10, wherein said piezoelectric fuel injector further includes an injector cavity, an injector orifice communicating with one end of said injector cavity to discharge fuel into a combustion chamber, a nozzle valve element positioned in one end of said injection cavity adjacent said injector orifice for movement between an open position in which fuel may flow through said injector orifice into the combustion chamber and a closed position in which fuel flow through said injector orifice is blocked, a control volume positioned at one end of said nozzle valve element, a drain circuit for draining fuel from said control volume to a low pressure drain, and an injection control valve positioned along said drain circuit to control fuel flow from said control volume to control movement of said nozzle valve element, said piezoelectric element controlling the movement of said injection control valve.

14. The system of claim 13, wherein said initial voltage and said primary voltage are approximately equal.

15. The system of claim 10, wherein said piezoelectric element has a maximum voltage rating, said initial voltage being greater than or equal to at least approximately 50% of said maximum voltage rating.

16. The system of claim 15, wherein said initial voltage is greater than or equal to at least approximately 90% of said maximum voltage rating.

17. The system of claim 10, wherein said piezoelectric element has a maximum voltage rating, said initial voltage being approximately equal to 100% of said maximum voltage rating.

18. The system of claim 10, wherein said intermediate voltage is greater than 40% of said initial voltage and less than 70% of said initial voltage.

19. The system of claim 10, wherein said controller is adapted to maintain said initial voltage for an initial voltage duration and vary the initial voltage duration to control the fuel injection rate.

20. The system of claim 10, wherein said controller is adapted to maintain said intermediate voltage for an intermediate voltage duration and vary the intermediate voltage duration to control the fuel injection rate.

21. The system of claim 10, wherein said controller is adapted to vary a magnitude of the intermediate voltage to control the fuel injection rate.

22. A piezoelectric fuel injection system for an internal combustion engine, said piezoelectric fuel injection system being adapted to inject fuel during an injection event of a combustion cycle, said piezoelectric fuel injection system comprising:

a piezoelectric fuel injection means for injecting fuel during said injection event, said piezoelectric fuel injection means including a piezoelectric element;

a power source means for providing voltage to said piezoelectric element to actuate said piezoelectric fuel injection means; and a control means for controlling said power source means to charge said piezoelectric element to an initial voltage to begin said injection event, for decreasing the voltage from said power source means from said initial voltage to an intermediate voltage, and for increasing the voltage from said intermediate voltage to a primary voltage to thereby control a rate of fuel injected by said piezoelectric fuel injection means during said injection event, said initial voltage being at least approximately equal to said primary voltage.

23. The system of claim 22, wherein said piezoelectric fuel injection means includes an injector cavity, an injector orifice communicating with one end of said injector cavity to discharge fuel into a combustion chamber, and a nozzle valve element positioned in one end of said injection cavity adjacent said injector orifice for movement between an open position in which fuel may flow through said injector orifice into the combustion chamber and a closed position in which fuel flow through said injector orifice is blocked, wherein the charge of said piezoelectric element to the initial voltage causes a rapid opening of said nozzle valve element and a corresponding rapid increase in the fuel injection rate, and the decrease of the voltage from said initial voltage to said intermediate voltage causes an opening of said nozzle valve element slower than said rapid opening and a slower increase in the fuel injection rate than said rapid increase.

24. The system of claim 23, wherein the increase of the voltage from said intermediate voltage to said primary voltage causes said nozzle valve element to move to a fully open position and the injection rate to reach a maximum level, said control means further functioning for maintaining said primary voltage for a predetermined period of time.

25. The system of claim 22, wherein said piezoelectric fuel injection means further includes an injector cavity, an injector orifice communicating with one end of said injector cavity to discharge fuel into a combustion chamber, a nozzle valve element positioned in one end of said injection cavity adjacent said injector orifice for movement between an open position in which fuel may flow through said injector orifice into the combustion chamber and a closed position in which fuel flow through said injector orifice is blocked, a control volume positioned at one end of said nozzle valve element, a drain circuit for draining fuel from said control volume to a low pressure drain, and an injection control valve positioned along said drain circuit to control fuel flow from said control volume to control movement of said nozzle valve element, said piezoelectric element controlling the movement of said injection control valve.

26. The system of claim 22, wherein said initial voltage and said primary voltage are approximately equal.

27. The system of claim 22, wherein said piezoelectric element has a maximum voltage rating, said initial voltage being greater than or equal to at least approximately 50% of said maximum voltage rating.

28. The system of claim 27, wherein said initial voltage is greater than or equal to at least approximately 90% of said maximum voltage rating.

29. The system of claim 22, wherein said piezoelectric element has a maximum voltage rating, said initial voltage being approximately equal to 100% of said maximum voltage rating.

30. The system of claim 22, wherein said control means functions for maintaining said initial voltage for an initial voltage duration and varying the initial voltage duration to control the fuel injection rate.

31. The system of claim 22, wherein said control means functions for maintaining said intermediate voltage for an intermediate voltage duration and varying the intermediate voltage duration to control the fuel injection rate.

32. The system of claim 22, wherein said control means functions for varying a magnitude of the intermediate voltage to control the fuel injection rate.

33. A method of controlling a piezoelectric fuel injection system for an internal combustion engine including a piezoelectric fuel injector, with a piezoelectric element for receiving a voltage, adapted to inject fuel during an injection event of a combustion cycle, said method comprising the steps of:

providing an initial voltage to said piezoelectric element of said piezoelectric fuel injector to begin said injection event;

decreasing the voltage to said piezoelectric element from said initial voltage to an intermediate voltage;

increasing the voltage to said piezoelectric element from said intermediate voltage to a primary voltage to thereby control a rate of fuel injected by said piezoelectric fuel injector during said injection event, said initial voltage being at least approximately equal to said primary voltage.

34. The method of claim 33, further including the steps of maintaining the intermediate voltage for an intermediate predetermined period of time and maintaining said primary voltage for a primary predetermined period of time.

35. The method of claim 33, wherein the step of providing an initial voltage to said piezoelectric element causes a rapid opening of a nozzle valve element of said piezoelectric fuel injector and a corresponding rapid increase in the fuel injection rate, and the step of decreasing the voltage from said initial voltage to said intermediate voltage causes an opening of said nozzle valve element slower than said rapid opening and a slower increase in the fuel injection rate than said rapid increase.

36. The method of claim 33, wherein the step of increasing the voltage from said intermediate voltage to said primary voltage causes said nozzle valve element to move to a fully open position and the injection rate to reach a maximum level, further including the step of maintaining said primary voltage for a predetermined period of time.

37. The method of claim 33, wherein said piezoelectric fuel injector includes a nozzle valve element, a control volume positioned at one end of said nozzle valve element, a drain circuit for draining fuel from said control volume to a low pressure drain, and an injection control valve positioned along said drain circuit to control fuel flow from said control volume to control movement of said nozzle valve element, said piezoelectric element controlling the movement of said injection control valve.

38. The method of claim 33, wherein said initial voltage and said primary voltage are approximately equal.

39. The method of claim 33, wherein said piezoelectric element has a maximum voltage rating, said initial voltage being greater than or equal to at least approximately 50% of said maximum voltage rating.

40. The method of claim 39, wherein said initial voltage is greater than or equal to at least approximately 90% of said maximum voltage rating.

41. The method of claim 33, wherein said piezoelectric element has a maximum voltage rating, said initial voltage being approximately equal to 100% of said maximum voltage rating.

42. The method of claim 33, further including the steps of maintaining said initial voltage for an initial voltage duration and varying the initial voltage duration to control the fuel injection rate.

43. The method of claim 33, further including the steps of maintaining said intermediate voltage for an intermediate voltage duration and varying the intermediate voltage duration to control the fuel injection rate.

44. The method of claim 33, further including the step of varying a magnitude of the intermediate voltage to control the fuel injection rate.

* * * * *